US008388168B1

(12) United States Patent
Li

(10) Patent No.: US 8,388,168 B1
(45) Date of Patent: Mar. 5, 2013

(54) SOLAR EXTENDABLE TRAY MAILBOX

(76) Inventor: Stephen Li, Stony Point, NY (US)

( * ) Notice: Subject to any disclaimer, the term of this patent is extended or adjusted under 35 U.S.C. 154(b) by 103 days.

(21) Appl. No.: 12/852,148

(22) Filed: Aug. 6, 2010

(51) Int. Cl.

| | |
|---|---|
| ***F21L 4/00*** | (2006.01) |
| ***F21L 13/00*** | (2006.01) |
| ***A47G 29/14*** | (2006.01) |
| ***G09F 23/00*** | (2006.01) |
| ***G09F 13/04*** | (2006.01) |

(52) U.S. Cl. ..... 362/183; 232/29; 232/38; 40/566; 40/576

(58) Field of Classification Search ..... 232/38, 232/29; 362/183; 40/566, 576
See application file for complete search history.

(56) References Cited

U.S. PATENT DOCUMENTS

| | | | | |
|---|---|---|---|---|
| 4,714,192 | A | 12/1987 | Harlow, Jr. et al. | |
| 4,947,300 | A * | 8/1990 | Wen | 362/183 |
| 5,007,190 | A * | 4/1991 | Shyu | 40/564 |
| 5,009,366 | A | 4/1991 | van Druff, Jr. et al. | |
| 5,271,555 | A * | 12/1993 | Mayer | 232/17 |
| 5,522,540 | A | 6/1996 | Surman | |
| 6,629,766 | B2 * | 10/2003 | Cathel | 362/183 |
| 6,698,651 | B1 * | 3/2004 | Green | 232/29 |
| 6,708,876 | B1 | 3/2004 | Shirah | |
| 6,719,193 | B2 * | 4/2004 | Katulka | 232/38 |
| 6,799,716 | B1 * | 10/2004 | Kuelbs | 232/39 |
| 6,964,366 | B2 * | 11/2005 | Peng et al. | 232/38 |
| 6,997,373 | B2 * | 2/2006 | Flores | 232/29 |
| 7,004,380 | B2 | 2/2006 | Gunvaldson | |
| 7,210,616 | B1 | 5/2007 | Van Watermulen | |
| 7,938,314 | B1 * | 5/2011 | Benesh | 232/45 |
| 8,042,729 | B2 * | 10/2011 | Dinh | 232/29 |
| 2003/0121191 | A1 * | 7/2003 | DeJarnette et al. | 40/576 |
| 2004/0211827 | A1 | 10/2004 | Gunvaldson | |
| 2005/0258227 | A1 | 11/2005 | Flores | |
| 2006/0118609 | A1 * | 6/2006 | Iannello | 232/38 |
| 2009/0196028 | A1 * | 8/2009 | Chao et al. | 362/183 |

FOREIGN PATENT DOCUMENTS

| | | |
|---|---|---|
| CA | 2.146.468 | 10/1996 |
| JP | 2005087453 | 4/2005 |

* cited by examiner

*Primary Examiner* — David J Makiya
(74) *Attorney, Agent, or Firm* — Michael I. Kroll

(57) ABSTRACT

A mailbox with a slidable tray to withdraw the contents therein and a solar powered illuminable, configurable display to enhance visibility of the dwelling number after nightfall.

12 Claims, 9 Drawing Sheets

SOLAR EXTENDABLE TRAY MAILBOX

BACKGROUND OF THE INVENTION

1. Field of the Invention

The present invention relates generally to mailboxes and, more specifically, to a mailbox with a sliding interior drawer to provide improved access to the contents contained therein and an illuminable exterior display that is configurable to conform to the number of the respective dwelling.

2. Description of the Related Art

There are other container boxes designed for storing mail. While these mailboxes may be suitable for the purposes for which they were designed, they would not be as suitable for the purposes of the present invention, as hereinafter described.

SUMMARY OF THE PRESENT INVENTION

A primary object of the present invention is to provide a mailbox having an interiorly disposed sliding tray.

Another object of the present invention is to provide a mailbox wherein said interiorly disposed sliding drawer is hingedly connected to the front access drawer.

Yet another object of the present invention is to provide a mailbox whereupon opening and pulling on said access door withdraws said sliding tray therefrom.

Still yet another object of the present invention is to provide a mailbox having an exterior display that is configurable to conform to the address of its respective dwelling.

An additional object of the present invention is to provide a mailbox wherein said configurable display is illuminable.

A further object of the present invention is to provide a mailbox having an illuminable configurable display that is powered by a solar cell disposed on the top portion thereof.

Additional objects of the present invention will appear as the description proceeds.

The present invention overcomes the shortcomings of the prior art by providing a mailbox with a slidable tray to withdraw the contents therein and a solar powered illuminable, configurable display to enhance visibility of the dwelling number after nightfall.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
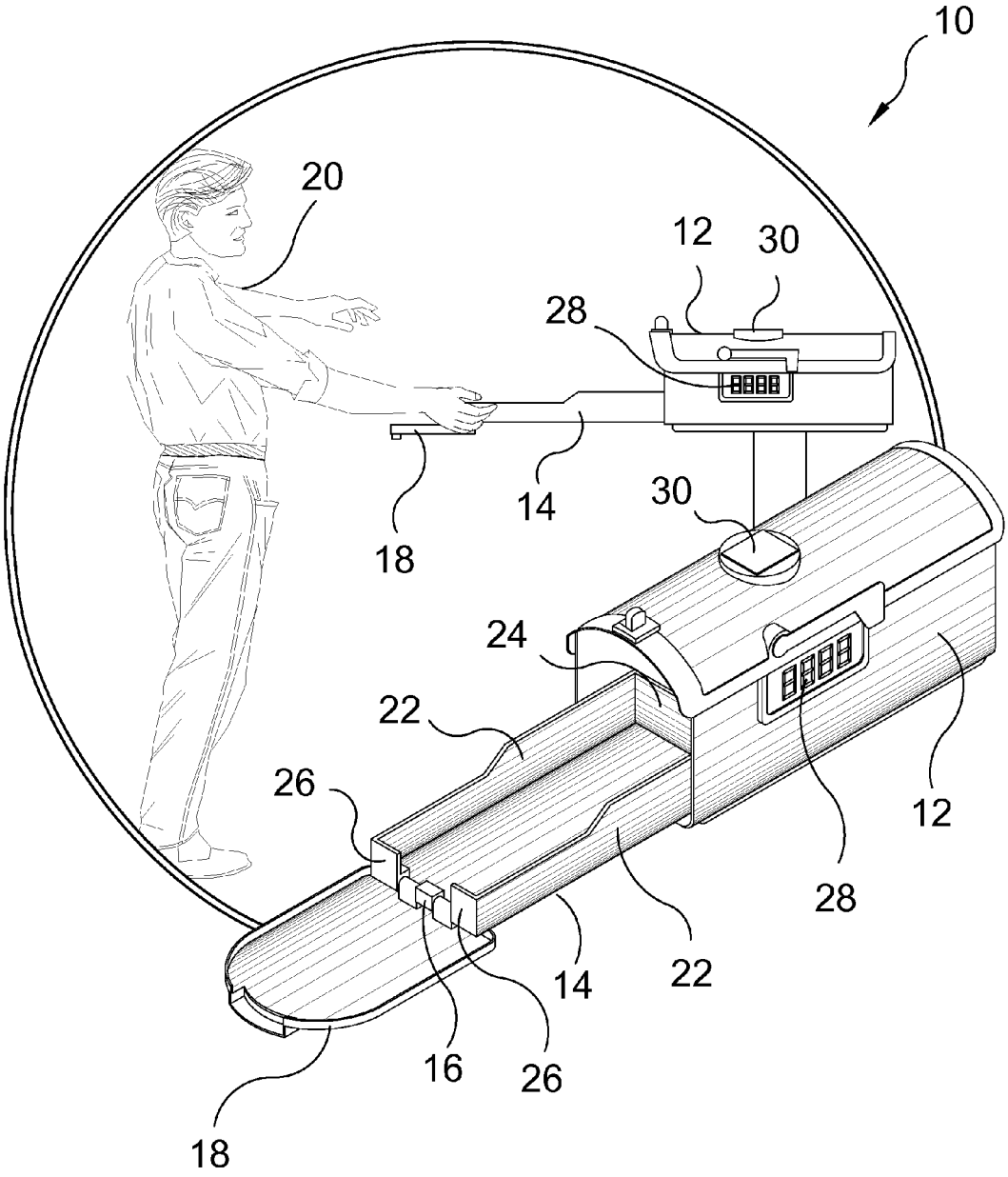
FIG. 1 is an illustrative view of the present invention in use.

Turning now descriptively to the drawings, in which similar reference characters denote similar elements throughout the several views, the figures illustrate the Solar Extendable Tray Mailbox of the present invention. With regard to the reference numerals used, the following numbering is used throughout the various drawing figures.

10 Solar Extendable Tray Mailbox of the present invention
12 housing
14 sliding tray
16 hinge
18 access door
20 user
22 side wall of 14
24 rear wall of 14
26 front walls of 14
28 illuminable display
30 solar cell
32 flag
34 latch
36 display elements
38 tinted illuminating plate
40 transparent placement template
42 opaque placement template
44 rechargeable battery
46 light sensor
48 switch

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments; practitioners skilled in the art will recognize numerous other embodiments as well. For definition of the complete scope of the invention, the reader is directed to appended claims.

FIG. 1 is an illustrative view of the present invention 10 in use. Shown is the present invention 10 being a mail box housing 12 having a sliding tray 14 that is hinged 16 to the access door 18 to allow the user 20 to pull out the contents of the mailbox into plain view for easy access. The sliding tray 14 has side walls 22, a rear wall 24 and front walls 26 depending therefrom. A pair of opposing illuminable displays 28 that are powered by a solar cell 30 are also provided.

Figure 2:
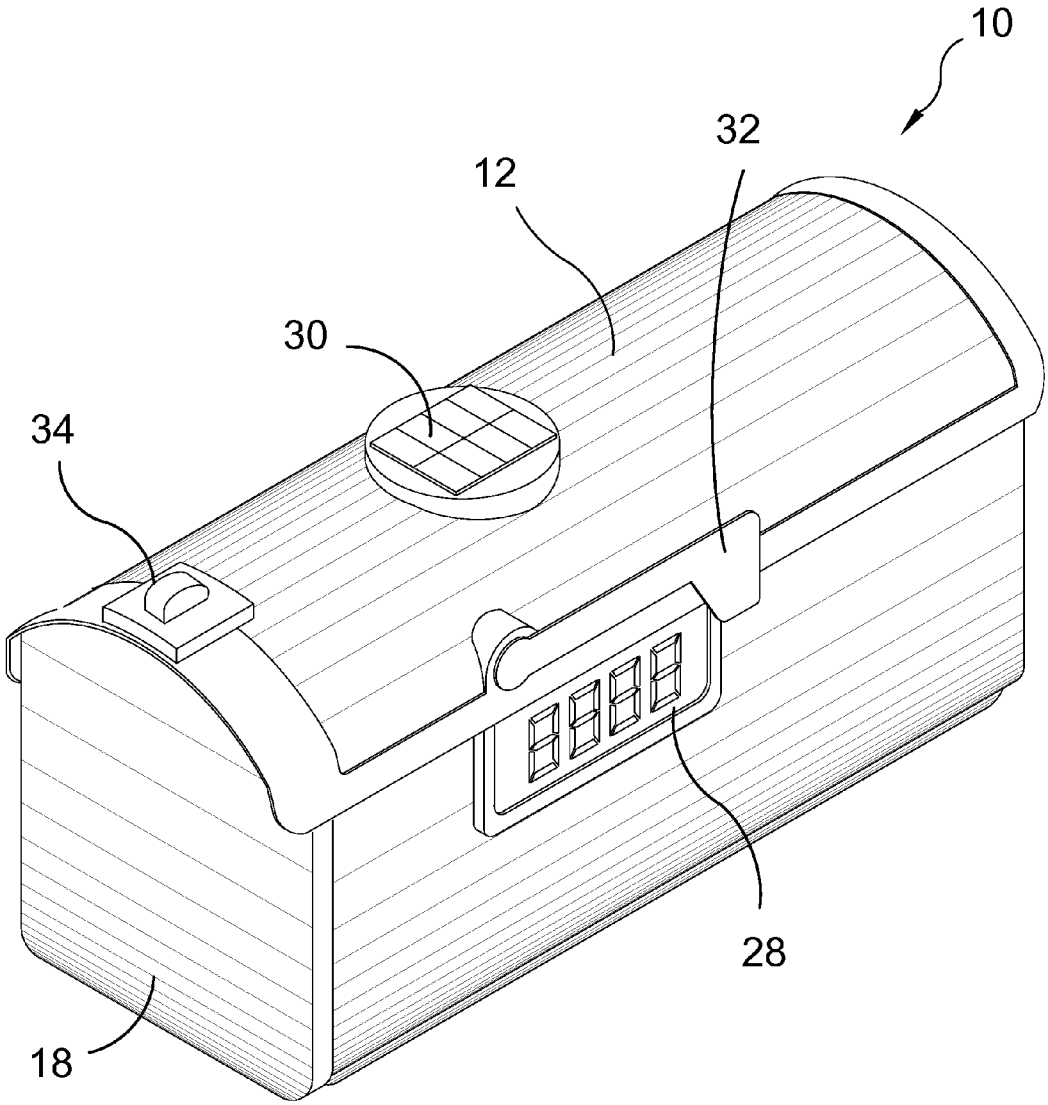
FIG. 2 is a perspective view of the present invention.

FIG. 2 is a perspective view of the present invention 10. Shown is the mailbox housing 12 with the access door 18 closed with a latch 34 and the illuminable display 28 and its respective solar cell 30 along with a flag 32 to announce that contents are stored therein.

Figure 3:
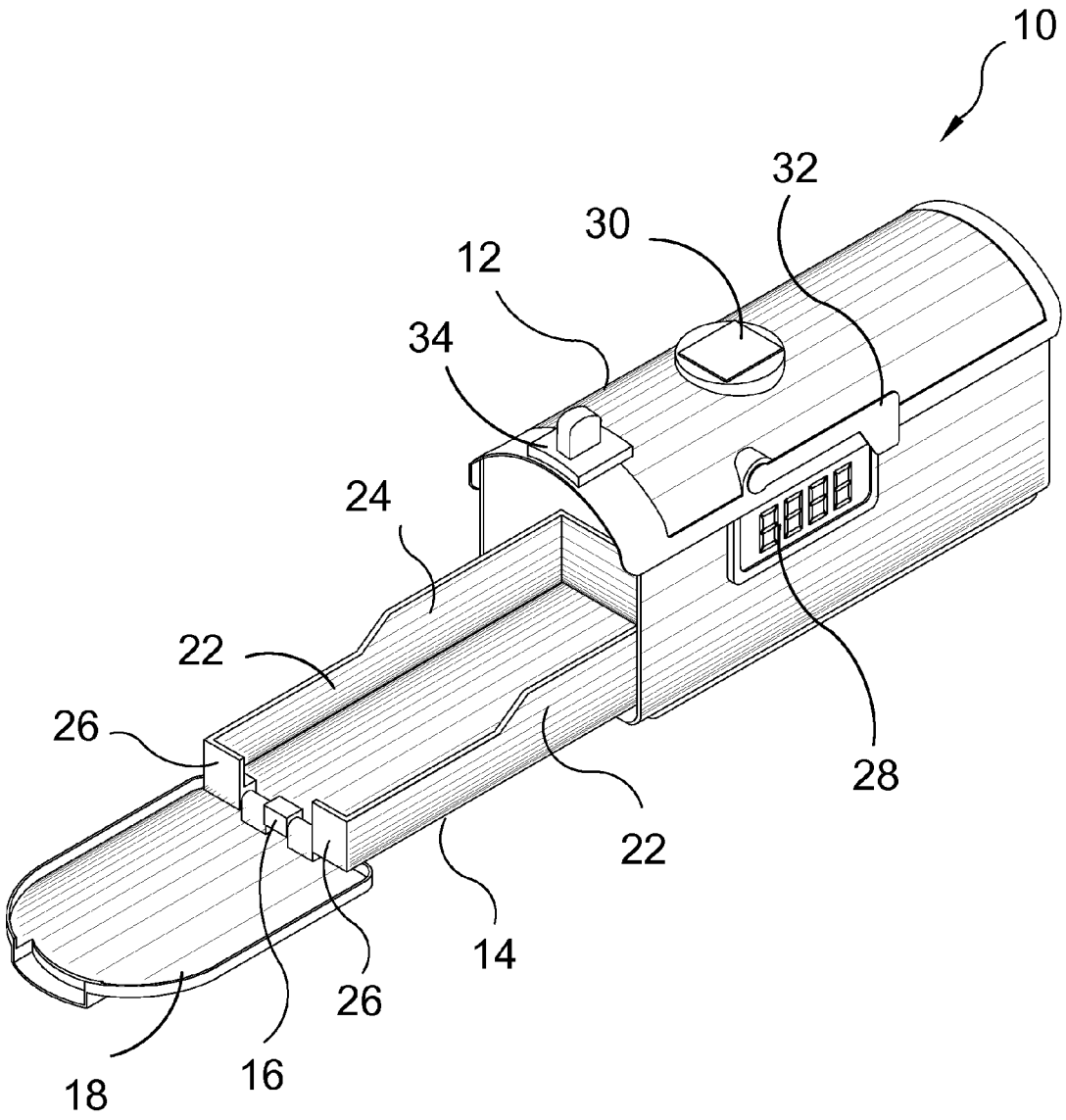
FIG. 3 is a perspective view of the present invention with the sliding tray extended.

FIG. 3 is a perspective view of the present invention 10 with the sliding tray extended. Shown is the present invention 10 being a mail box housing 12 having a sliding tray 14 that is hinged 16 to the access door 18 to allow the user to pull out the contents of the mailbox into plain view for easy access. The sliding tray 14 has side walls 22, a rear wall 24 and front walls 26 depending therefrom. A pair of opposing illuminable displays 28 that are powered by a solar cell 30 are also provided along with a latch 34 to secure the access door 18 in the closed position and a pivotable flag 32.

Figure 4:
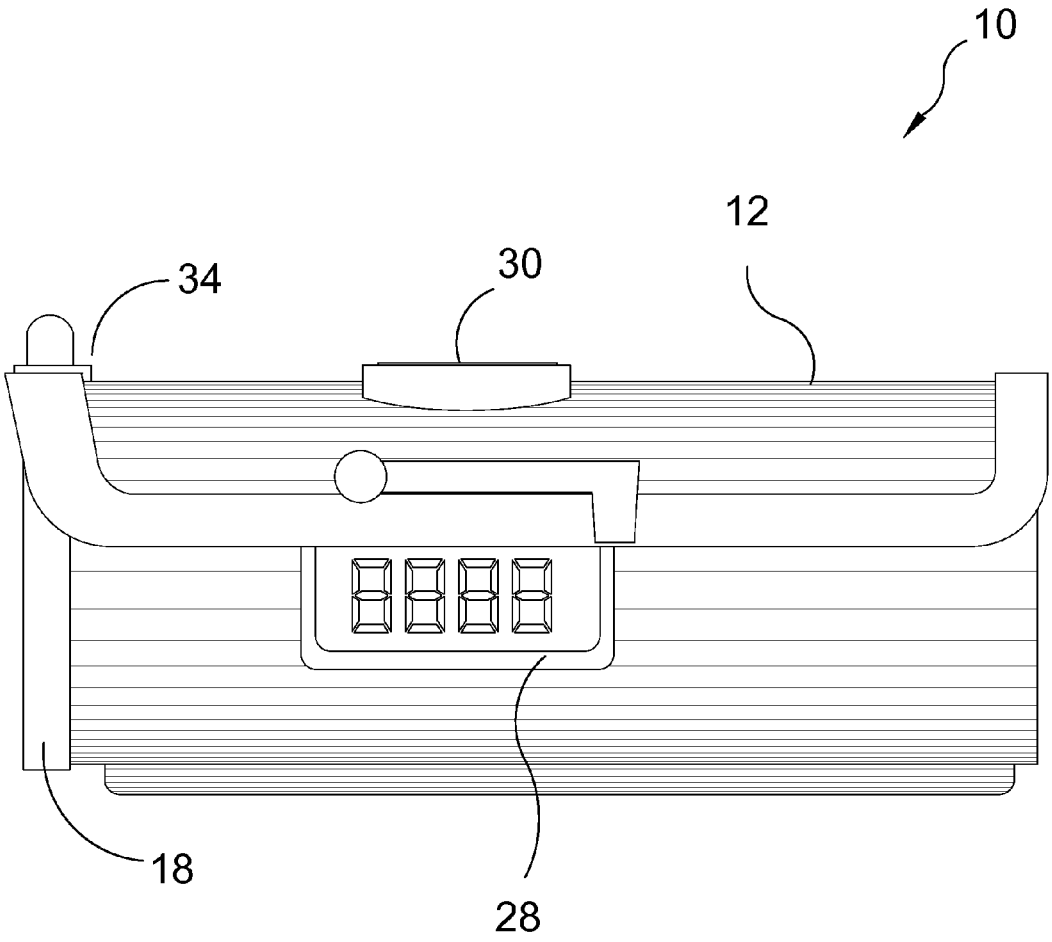
FIG. 4 is a side view of the present invention.

FIG. 4 is a side view of the present invention 10. Shown is the housing 12 with the access door 18 secured in the secured in the closed position by the latching mechanism 34 and the illuminable display 28 powered by a solar cell 30.

Figure 5:
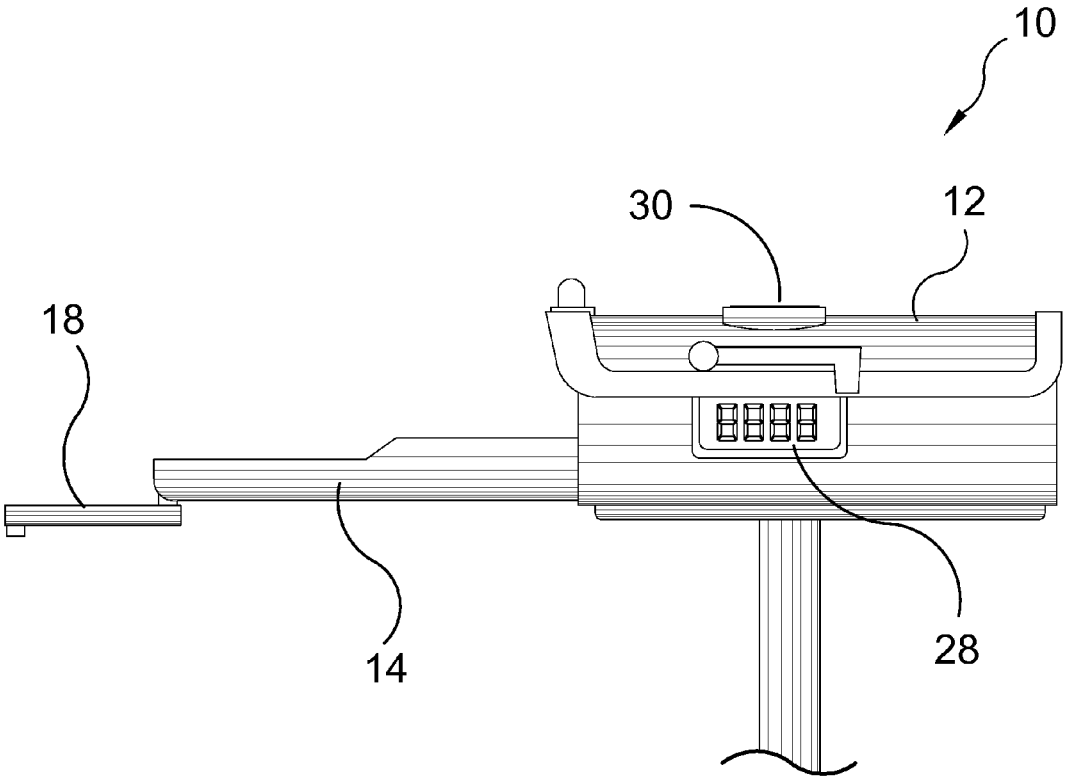
FIG. 5 is a side view of the present invention with the sliding tray extended.

FIG. 5 is a side view of the present invention 10 with the sliding tray 14 extended. Shown is the present invention's sliding tray 14 that is attached to the access door 18, opened and slid out to allow the user to pull out the contents of the mailbox housing 12 into plain view before retrieving them. Also shown is the illuminable display 28 and the solar cell 30.

Figure 6:
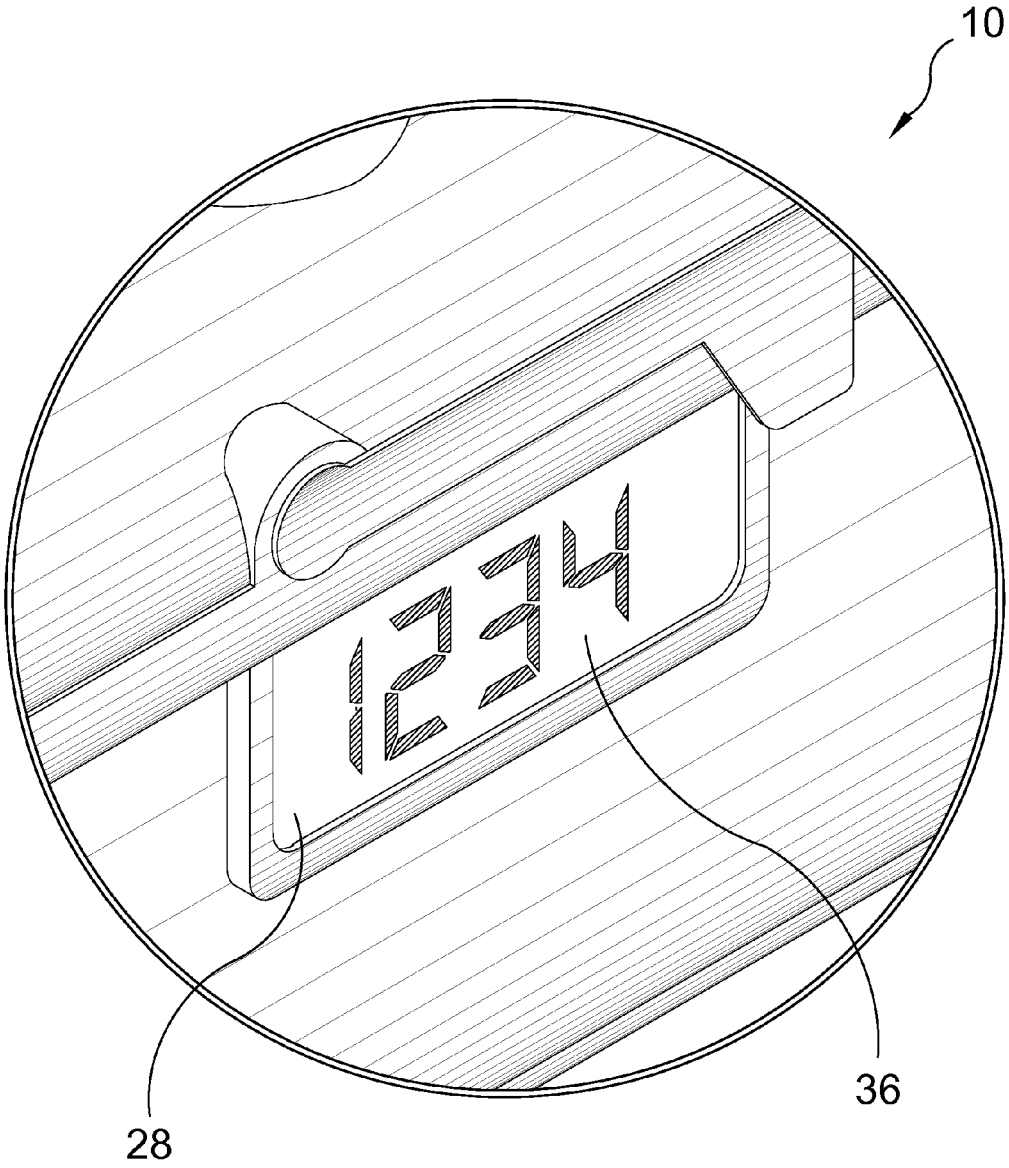
FIG. 6 is a detailed perspective view of the configurable display.

FIG. 6 is a detailed perspective view of the configurable display 28. Shown is the display of the present invention 10. The display 28 of the present invention 10 is composed in one of two different arrangements whereby display elements 36 are placed upon the display panel in an arrangement to define the numbers. Once the display elements 36 are arranged a back light is applied and powered via a solar cell in order to illuminate the chosen display.

Figure 7:
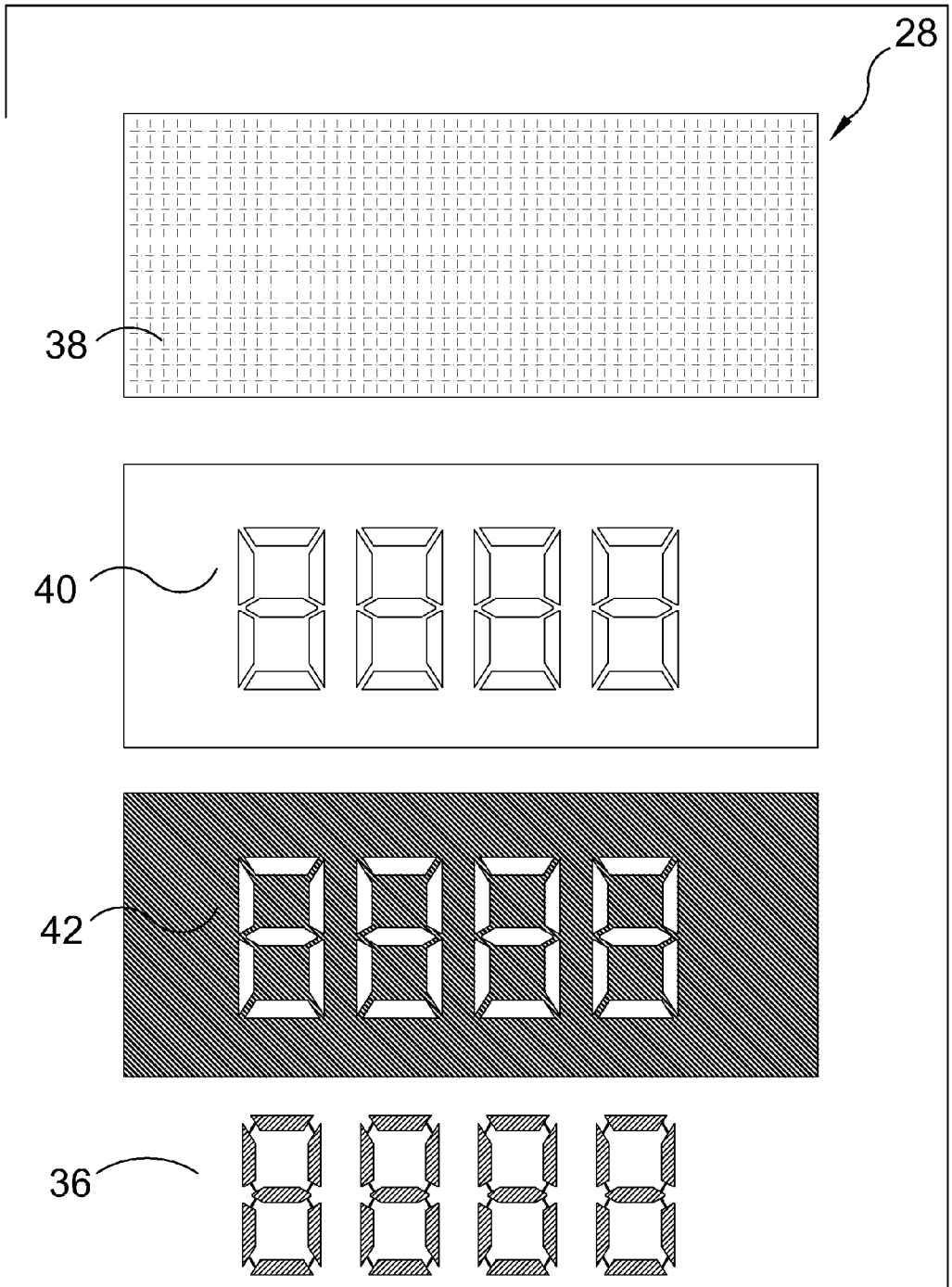
FIG. 7 is a front view of the illuminable elements.

FIG. 7 is a front view of the illuminable display 28 elements. Shown are the display elements of the present invention composed tinted illuminating template 38, transparent placement template 40, opaque placement template 42 and display elements 36 that are placed together to form a customized display.

Figure 8:
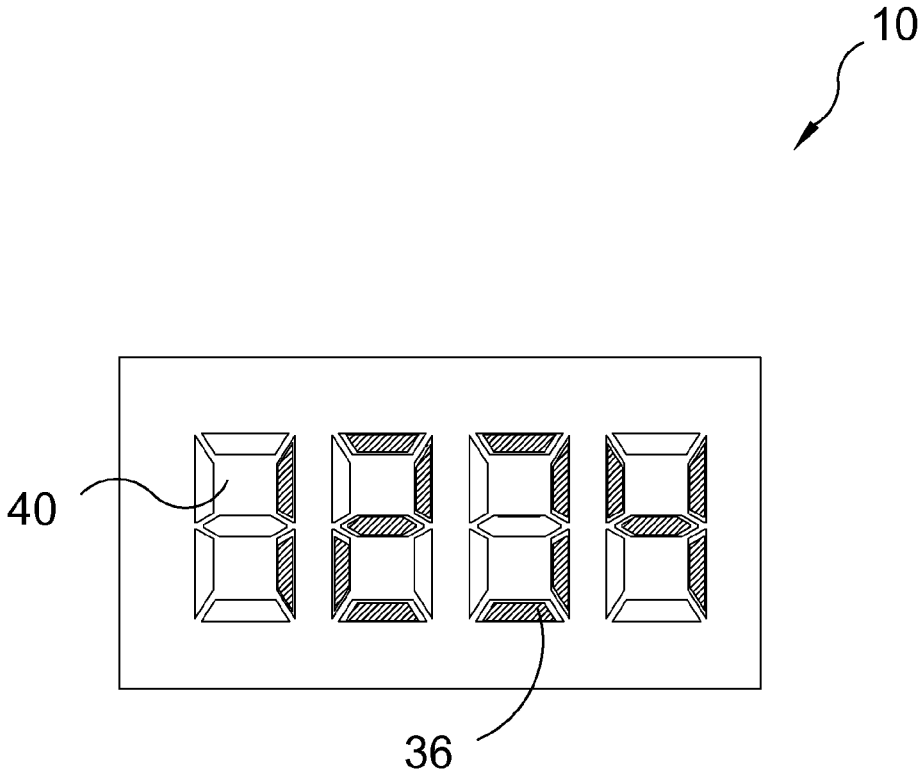
FIG. 8 is a front view of the transparent placement template.

FIG. 8 is a front view of the transparent placement template 40. Shown is the display elements 36 of the present invention 10 assembled into a 5 number sequence. Once the display is customized it is then inserted into the display area where then it is illuminated via a solar cell.

Figure 9:
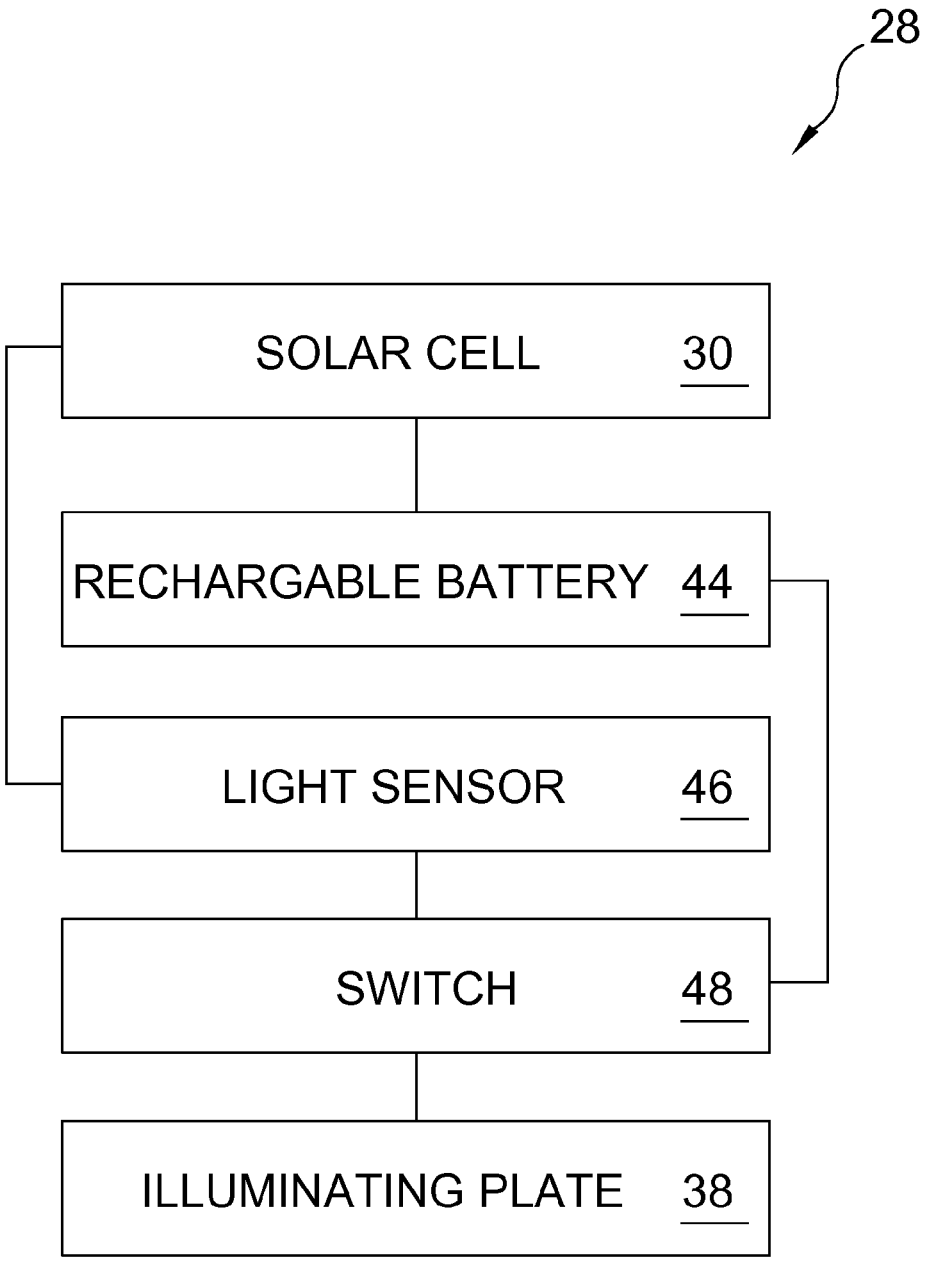
FIG. 9 is a front view of an alternate configuration of the circuit of the illuminable display.

FIG. 9 is a block diagram of an alternate configuration of the power source for the illuminable display 28. The solar cell 30 provides a charge to at least one rechargeable battery 44 and the illuminating plate 38 is energized by a switch 48 in communication with a light sensor 46 when the ambient light reaches a predetermined minimum.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A solar extendable tray mailbox comprising:

a) a mailbox housing having a front opening;

b) a tray disposed within said housing that is slidable from an interior portion thereof to an exterior portion;

c) an access door for closing said front opening, said access door being hinged on a front bottom edge of said tray whereby when said tray is fully extended out from said front opening said access door forms an extension of a bottom of said tray;

c) an illuminable, configurable display to correspond with a number of its respective dwelling; and d) said tray having side walls and a pair of spaced front walls, with a hinge for said access door mounted between said front walls.

2. The solar extendable tray mailbox according to claim 1, wherein said illuminable configurable display is powered by a solar cell disposed on a top portion of said housing.

3. The solar extendable tray mailbox according to claim 2, wherein said illuminable, configurable display includes a tinted illuminating plate in electrical communication with said solar cell.

4. The solar extendable tray mailbox according to claim 3, wherein said illuminable, configurable display further comprises a transparent placement template.

5. The solar extendable tray mailbox according to claim 4, wherein said illuminable, configurable display further includes an opaque placement template.

6. The solar extendable tray mailbox according to claim 5, wherein said illuminable, configurable display further includes display elements to define a plurality of illuminated windows displaying their respective numbers.

7. The solar extendable tray mailbox according to claim 6, wherein said display elements have tear off sections to allow a user to conform displayed numbers to the number of the respective dwelling.

8. The solar extendable tray mailbox according to claim 5, wherein said opaque placement template is adapted to allow appropriate sections thereof to be blocked out to define the number in the illuminated window of the respective dwelling.

9. The solar extendable tray mailbox according to claim 3, further including at least one rechargeable battery that is in electrical communication with said solar cell.

10. The solar extendable tray mailbox according to claim 9, further comprising a light sensor incorporated with said solar cell.

11. The mailbox solar extendable tray mailbox according to claim 10, including a switch disposed in the electrical circuit between said at least one rechargeable battery and said tinted illuminating plate.

12. The solar extendable tray mailbox according to claim 11, whereupon said light sensor is adapted to detect an ambient light below a predetermined setting activates said switch to energize said illuminating plate.

* * * * *